US005431617A

United States Patent [19]

Rattray, Jr.

[11] Patent Number: 5,431,617

[45] Date of Patent: Jul. 11, 1995

[54] RESILIENT CORD EXERCISE DEVICE FOR ATTACHMENT TO A STATIC STRUCTURE

[76] Inventor: Samuel W. Rattray, Jr., 613 Point DeFiance Ct., Chula Vista, Calif. 91911

[21] Appl. No.: 278,702

[22] Filed: Jul. 21, 1994

Related U.S. Application Data

[63] Continuation of Ser. No. 110,126, Aug. 20, 1993, abandoned.

[51] Int. Cl.[6] ..... A63B 21/04

[52] U.S. Cl. ..... 482/129; 482/121; 482/126; 482/123

[58] Field of Search ..... 482/129, 130, 904, 126, 482/121, 123

[56] References Cited

U.S. PATENT DOCUMENTS

| | | | |
|---|---|---|---|
| 1,750,549 | 3/1930 | Thomson et al. | 482/130 |
| 2,274,574 | 2/1942 | Zerne | 482/129 |
| 3,618,942 | 11/1971 | Bates | 482/129 |
| 3,633,907 | 1/1972 | Cane | 482/123 |
| 3,815,904 | 6/1974 | Weiss et al. | 482/123 |
| 4,852,873 | 8/1989 | O'Donnell et al. | 482/126 |
| 5,112,287 | 5/1992 | Brewer | 482/130 |
| 5,269,737 | 12/1993 | Sobotka | 482/130 |

*Primary Examiner*—Richard J. Apley
*Assistant Examiner*—Lynne A. Reichard
*Attorney, Agent, or Firm*—Gilliam, Duncan & Harms

[57] ABSTRACT

An exercise device having a single central element anchored to a fixed structure with a plurality of elastic cables extending from an equal number of "S" type hooks to an elongated handle member. The elastic cables are attached at their ends opposite to the "S" hook attachment to the elongated handle which is covered with a foam type gripping material. The elastic cables attached to the elongated handle member are spaced apart so that the fingers of a human hand grasping the handle will pass between adjacent elastic cables. The elongated handle member is bent formed in a direction away from the handle attachment of the elastic cables at each end thereof with the central elastic cable attachment portion being slightly curved in a concave fashion in a direction facing the elastic cable attachment. Selected ones of the elastic cables can be removed or added at discrete locations along the concave portion of the elongated handle to vary the stress or pull required for particular body part being exercised.

7 Claims, 1 Drawing Sheet

RESILIENT CORD EXERCISE DEVICE FOR ATTACHMENT TO A STATIC STRUCTURE

This is a continuation of application Ser. No. 08/110,126, filed on Aug. 20, 1993, now abandoned.

BACKGROUND OF THE INVENTION

The invention is directed to an exercise device and particularly to an exercise device for selectively varying the degree of stress or pull desired for a body part of a particular person.

U.S. Pat. No. 4,779,867 by inventor Robert S. Hinds teaches an elastic cable having stirrups fixed to each end thereof and an elongated bar having ends that receive a central portion of a cable and hold the stirrups separated one from the other during exercising. The cables are formed from resilient material that is longitudinally elastically stretchable against a fixed structure to which the device is secured.

U.S. Pat. No. 5,176,602 by inventor William J. Roberts teaches an exercise device attached to a fixed structure. As shown in FIG. 3 of the Patent, the device includes a door frame anchor. The anchor includes a single attachment member for attaching a plurality of elastic extendable cables. the other end of the cables are attache to a single centrally positioned attachment point on an elongated handle member.

Neither of these exercise devices allow the user to spread the resistance of the elastic elongatable cables over a large handle surface area with spaces therebetween for the fingers of a human hand which can be selectively removed or attached to the handle to position or vary the pull resistance or to specifically position the pull resistance at discrete locations along the handle cable attachment area.

There has not been a basic exercise device of this type that is versatile for selectively varying the pull resistance and location of the selected pull resistance along the grasping handle until the emergence of this invention.

SUMMARY OF THE INVENTION

The exercising device of the invention comprises an attachment ring which is attached by threaded engagement or the like to any fixed in place structure suitable for the required force thereagainst. A plurality of "S" shaped hooks are attached to the attachment ring. One end of each of the plurality of stretchable elastic cables of substantially the same length are removably attached to a separate one of the "S" hooks. The other end of the plurality of stretchable elastic cables are removably attached in a spaced apart relationship along a central concave portion of an elongated handle member. The ends of the elongated handle member are bent away from the central concave portion. The overall surface of the handle is covered with a soft spongy material for comfort to the hand or hands of the user gripping the handle during us of the device. The attachment of the stretchable elastic cables to the "S" hooks and the handle allows for relative movement between the stretchable elastic cables and the hook and handle.

The space between the handle attachment of the plurality of stretchable elastic cables allows for the gripping of a human hand with the finger thereof positioned between the adjacent cables. The cables are selectively removable to vary the resistance and the location of the resistance when pulling the handle and stretching the elastic cables against the fixed attachment of the device.

An object of this invention is to provide an exercising device for selected portions of the human body where the resistance to stretching of the cables of the device against a fixed position can be varied as to resistance and to location of that resistance relative to the body portions being exercised.

Another object of the invention is to provide a gripping surface between each of a plurality of stretchable attachment positions suitable for receiving the fingers of a human hand.

Still another object of this invention is to provide a attachment means at each end of the stretchable cable to quickly disconnect selected individual cables from the exercise device to vary the resistance and location of that resistance relative to the grasping surface of the device when exercising.

This and other objects and advantages of the present invention will become apparent to those skilled in the art after considering the following detailed specification in which the preferred embodiment are described in conjunction with the accompanying drawing Figures.

DESCRIPTION OF THE PREFERRED EMBODIMENT

Figure 1:
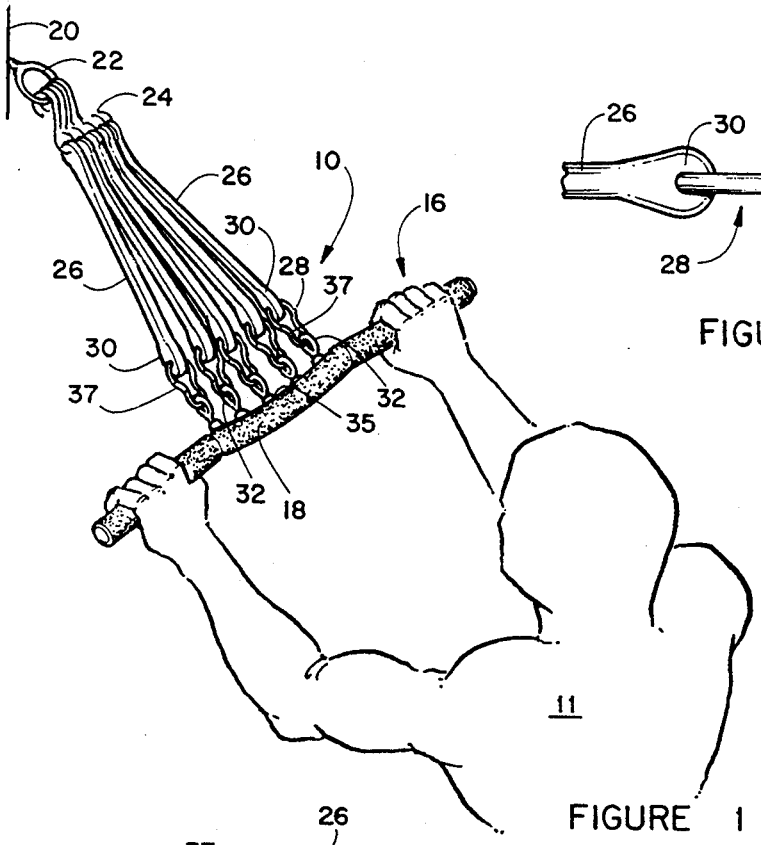
FIG. 1 depicts a perspective showing of the exercise device of the invention being operated in a first mode.

Referring now to the various drawing Figures, in FIG. 1 the exercising device 10 is shown being grasped by both hands of a person 11 desiring body exercise at the outer ends of a handle 16. The handle 16 is covered with a material 18 which is soft to the body portions of the exerciser using the device and also prevents the slipping of the engaging body portion which prevents physical damage to the user.

The exercising device 10 is removably connected to a fixed in place object 20 suitable for withstanding the pull force required when the device is used as intended and hereinafter described in more detail. The attachment to the object 20 is by means of an eye 22 which is either threaded into the object or connected thereto by any other convenient means suitable for the purpose intended.

Removably attached to the eye 22 is a plurality of hooks 24 which are movable relative to the eye. The hooks 24 are open at each "S" surface for selected removal or attachment to the eye 22. Attached to the "S" hooks and the flat portion of the handle are a plurality of removably attached resilient stretchable cables 26 having substantially the same length. The cables 26 can be "BUNGEE" cords, rubber bands, surgical rubber tubes or the like which will provide a desired resistance to stretching. The cables may have substantially the same amount of resistance to stretching or may each have different degrees of resistance to stretching to provide the user with the degree of stretch resistance at desired locations along the handle as required for the regiment of exercise desired by each individual exerciser.

Figure 3:
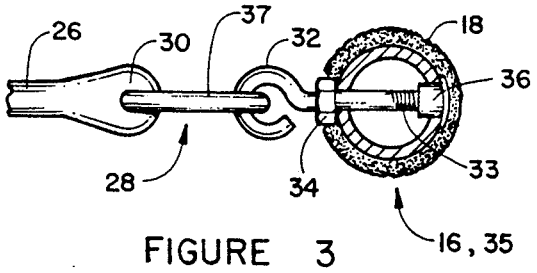
FIG. 3 depicts a cross-section of the handle of the exercise device of FIG. 1 showing a stretchable elastic cable attachment means.
Figure 4:
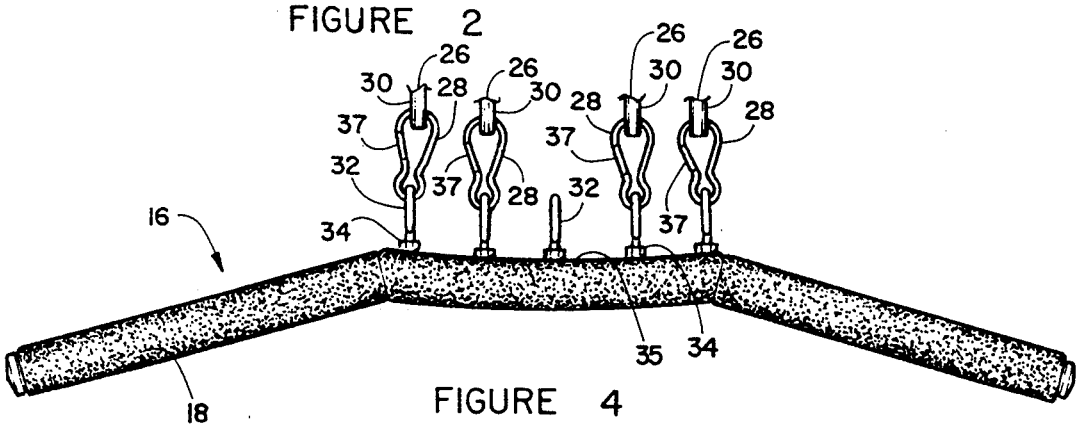
FIG. 4 is a front view of the grasping handle of the exercise device of FIGS. 1 and 2 showing the central concave portion and end portions bent away from the central portion.

Referring now also to the drawing FIGS. 3 and 4, the handle connection of the cables is through a clip 28 which interconnects the end 30 of each of the cables to a fixed in position eye 32 attached to the handle along the concave portion 35. The clip has a pivotable side portion 37 which allows the normally closed loop of the clip to be opened so that the clip and cable can removed from the handle. As shown in the various drawing Figures, five eyes for cable connections are shown for interconnecting up to five cables between the fixed attachment 22 and the handle 16. It should be understood that any desired number of cables 26 in addition to those shown could be utilized to practice this invention.

The eye 32 has an elongated shank with threads 33 on the end opposite the eye. The shank passes through an aperture partially through the handle diameter and threadedly engages a "T" nut 36 passing into an oppositely positioned aperture. A lock nut 34 adjacent to the eye bearing on the handle surface looks the eye shank to the handle to prevent relative movement therebetween.

The central portion of the handle is slightly concave at the cable attachment thereto. This concave area allows for the resistance to pull at the center of the handle be to slightly greater than the other cables. This feature directs increased resistance to the center of the handle when all of the cables are in use or when only cables from the center connections are attached.

The handle can be constructed of steel, aluminum, or any other suitable material suitable for the purpose intended.

Figure 2:
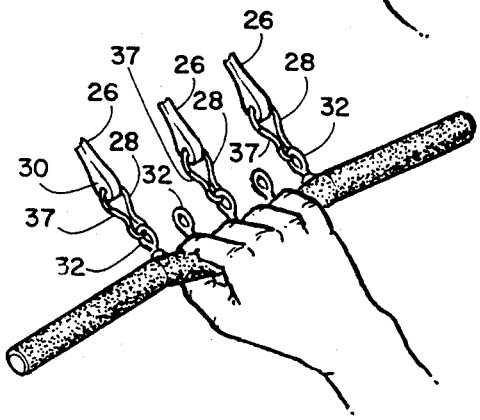
FIG. 2 depicts a partial showing of the exercise device of FIG. 1 being operated in a second mode.

In use the person desiring body exercise either grasps the handle and pulls the cables against the fixed attachment of the device as shown in drawing FIGS. 1 and 2 or pushes the cables away from the fixed structure.

While there has been shown and described preferred embodiments of the exercising device in accordance with the invention, it will be appreciated that many changes and modifications may be made therein without, however, departing from the essential spirit thereof.

What is claimed is:

1. An exercising device comprising;

first attachment means for attaching said exercising device to a fixed in place structure;

a plurality of single independent resilient cables;

a second attachment means suitable for attaching the first end of each of a selected number of said plurality of resilient cables to said first attachment means;

a handle member having a concave central portion configured for gripping by either of a person's hands and rectilinear end portions, each end portion configured for gripping by one of a person's hands, said end portions angled away from said concave central portion at a shallow angle to said concave central portion; each end portion having a first end connected to said concave central portion and a second free end; and a plurality of discretely positioned spaced apart third attachment means located along said concave central portion of said handle for separately removably attaching the second end of each of said selected number of said plurality of independent resilient cables to said handle.

2. The invention as defined in claim 1 wherein said first attachment means is a bolt having an "eye" portion threaded into said support structure at one end and movably attached to said plurality of second attachment means at said "eye" portion.

3. The invention as defined in claim 1 wherein said plurality of second attachment means are "S" shaped hooks movably attached to said first attachment means.

4. The invention as defined in claim 1 wherein said central concave portion of said handle is a continuous curve and at least the gripping surface of said handle is covered with a soft spongy material.

5. The invention as defined in claim 1 wherein said resilient cables are "bungee" cords.

6. The invention as defined in claim 1 wherein said resilient cables are formed from lengths of surgical rubber tubing.

7. The invention as defined in claim 1 wherein said plurality of spaced apart third attachment means are eye hooks each having a shank passing partially through said handle threadedly engaging a "T" nut extending from the side of said handle opposite the eye of said eye hooks and a lock nut adjacent to said eye for locking said eye hook to said handle to prevent relative movement between said eye hook and said handle.

* * * * *